US006019642A

United States Patent [19]

Nagata

[11] Patent Number: 6,019,642

[45] Date of Patent: Feb. 1, 2000

[54] CATHODE-RAY TUBE SOCKET

[75] Inventor: Takayuki Nagata, Higashiosaka, Japan

[73] Assignee: Hosiden Corporation, Osaka, Japan

[21] Appl. No.: 09/160,303

[22] Filed: Sep. 25, 1998

[30] Foreign Application Priority Data

Oct. 24, 1997 [JP] Japan ..... 9-292555

[51] Int. Cl.[7] ..... H01R 33/76

[52] U.S. Cl. ..... 439/683; 439/441

[58] Field of Search ..... 439/682, 683, 439/182, 181, 438, 441

[56] References Cited

U.S. PATENT DOCUMENTS

| | | | |
|---|---|---|---|
| 3,125,392 | 3/1964 | Winter | 439/441 |
| 3,805,108 | 4/1974 | Suzuki | 439/683 |
| 3,818,278 | 6/1974 | Adler | 439/683 |
| 4,400,645 | 8/1983 | Simovits, Jr. et al. | 439/683 |

*Primary Examiner*—Hien Vu

*Attorney, Agent, or Firm*—Pollock, Vande Sande & Amernick

[57] ABSTRACT

In a cathode-ray tube socket, including a socket body having a plurality of contact seating sections for receiving terminal pins of a cathode-ray tube and a high-voltage contact seating section adapted to accommodate a high-voltage terminal pin of the cathode-ray tube, the contact seating sections and the high-voltage contact seating section being formed in the socket body and arrayed on a common circle, and a high-voltage discharge chamber formed integrally with the socket body on a peripheral side wall of the body; the high-voltage discharge chamber is provided with a first quick-connect type lead cable connector section for connecting with a focusing lead cable from a flyback transformer, and a second quick-connect type lead cable connector section is formed integrally with the socket body on the peripheral side wall of the body for connecting with a screening lead cable from the flyback transformer. A lead cable pinching formation accommodated in a lead cable pinching chamber of the first lead cable connector section is connected with a high-voltage contact accommodated in a high-voltage contact seating section, and a lead cable pinching formation accommodated in a lead cable pinching chamber of the second lead cable connector section is connected with a low-voltage contact accommodated in one of low-voltage contact seating sections.

11 Claims, 6 Drawing Sheets

CATHODE-RAY TUBE SOCKET

BACKGROUND OF THE INVENTION

This invention relates to a cathode-ray tube socket and, more particularly, to a cathode-ray tube socket having a connector section for connecting screen lead cables and ground lead cables connected with a substrate having the cathode-ray tube socket mounted thereon.

An example of the prior art cathode-ray tube socket will be described with reference to FIGS. 1 and 2. A cathode-ray tube socket 11 made of electrically insulating material comprises a socket body 12 into which terminal pins of the cathode-ray tube are inserted for connection, and a high-voltage discharge chamber 13 integrally molded with the side of the body. The socket body 12 is generally in the form of a disc plate having a substantial thickness and is formed with a housing portion 15 for accommodating the base (not shown) of the cathode-ray tube having a circular cross-section centered on the central line 14 of the body. The socket body 12 is further formed with a plurality of contact seating sections 17 circumferentially equally spaced apart and annularly arrayed on a circle around the central line 14 and corresponding terminal pin insertion apertures 16 through which the terminal pins are inserted. The contact seating sections 17 are in communication with the corresponding terminal pin insertion apertures 16 and extend rearwardly upto the back face of the cathode-ray tube socket 11. Accommodated in these contact seating sections 17 are low-voltage contacts 18. Formed in the socket body 12 at a position substantially equally spaced from the opposite ends of the circular array of the contact seating sections 17 and the communicating terminal pin insertion apertures 16 and located on the circle common to that on which the contact seating sections 17 are arrayed is a high-voltage contact seating section 17*h* in which there is accommodated a high-voltage contact 18*h* for connection with a high-voltage terminal pin of the cathode-ray tube.

In this example, the socket body 12 is formed around its outer periphery with a stepped portion 12S over which there is fitted an exposed grounding conductor 19 in the form of an arcuately bent strip. As shown in FIG. 3, the grounding conductor strip 19 has discharge electrode tongues 19T spaced at equal angular intervals and each formed in its center with a spherical protrusion 19P. There are discharge chambers 21 defined between the middle portions of the terminals of the annularly arrayed contacts 18 and the corresponding discharge electrode tongues 19T of the grounding conductor 19. In each of the discharge chambers 21 there is defined a discharge gap between the spherical protrusions 19P each of the discharge electrode tongues 19T of the grounding conductor 19 and the middle portion of the terminal 18T of the contact 18.

Referring to FIGS. 1, 2, 4 and 5, the high-voltage discharge chamber 13 is defined by a generally rectangular housing 42 integrally formed with the side of the socket body 12 adjoining the high-voltage contact seating section 17*h*, and a rectangular cover 43 closing the top opening of the rectangular housing 42. Disposed in the high-voltage discharge chamber 13 is a pair of high-voltage discharge electrodes 31 and 32 spaced apart to define a high-voltage discharge gap therebetween. The high-voltage contact 18*h* and the high-voltage discharge electrode 31 are interconnected by means of a connecting conductor 33 (FIGS. 1, 2 and 5). The high-voltage discharge electrode 31 is semi-spherical in shape and has a rectangular flange-like fixing plate 35 integrally formed therearound. The fixing plate 35 is fitted in a slit 71 formed in a high-voltage discharge electrode retaining wall 70 (FIG. 4) provided in the interior of the high-voltage discharge chamber 13 to hold the high-voltage discharge electrode 31 in place in the high-voltage discharge chamber 13. The other high-voltage discharge electrode 32 is likewise semi-spherical and has a rectangular mounting flange 36 integrally formed therearound. The mounting flange 36 is also held in the high-voltage discharge chamber 13. The convex surfaces of the high-voltage discharge electrodes 31 and 32 are in opposing relation to each other to define a high-voltage discharge gap therebetween. The cover 43 has U-shaped integral engaging portions 61 depending from the opposite side walls thereof and adapted to snap into engagement with locking engagement protuberances 62 formed on the opposite side walls of the housing 42 when the cover 43 is fitted over the housing 42 to close the open top of the housing 42.

As shown in FIG. 4, the high-voltage discharge electrode 31 has a lead cable pinching chamber 41 formed in the back face thereof. A connecting portion 38 extends from one side edge of the fixing plate 35 of the high-voltage discharge electrode 31 perpendicularly into the lead cable pinching chamber 41 in which the connecting portion 38 extends upwardly to form a receiving plate 39 in spaced and opposing relation to the fixing plate 35. The receiving plate 39 is bent downwardly obliquely at an acute angle o to form a contact tab 37 which defines between the contact tab and the fixing plate 35 a gap narrowing progressively as the tab extends downwardly. The fixing plate 35 and the contact tab 37 thus defines a lead cable pinching member 30, and a lead cable insertion aperture 48 is formed through the cover 43 for guide the leading end of a lead wire or cable toward the gap of the lead cable pinching member 30 with a tubular projection 49 concentric with and surrounding the lead cable insertion aperture 48 and extending integrally upwardly from the top surface of the cover 43. The top wall, that is, the cover 43 of the lead cable pinching chamber 41 is formed adjacent the tubular projection 49 with a slot 52 communicating with the lead cable pinching chamber 41.

The lead cable insertion aperture 48 is located in proximity to and in opposition to the distal end of the contact tab 37 so that the core of the high-voltage focusing lead cable G3 which is an external lead cable may be inserted through the insertion aperture 48 into the lead cable pinching chamber 41 to resiliently hold the leading end of the core between the fixing plate 35 and the contact tab 37 of the lead cable pinching member 30. The inner diameter of the tubular projection 49 surrounding the periphery of the lead cable insertion aperture 48 is made approximately equal to the outer diameter of the insulation coating of the lead cable G3 so as to act as a guide for the high-voltage focusing lead cable G3 as it is inserted into the chamber 41 as well as to snugly embrace the insulation coating of the lead cable to thereby prevent vibration thereof.

A generally rectangular swing plate 53 is connected integrally with the side of the socket body 12 opposite from the cover 43 by means of a hinge 54 (FIGS. 1 and 2) formed integrally with the side of the socket body. The swing plate 53 has a retaining tab 51 formed integrally with and bent at a right angle to the plate 53 so that the tab 51 may be rotated into the housing 42 through the slot 52 formed in the cover 43 as the swing plate 53 is pivoted about the hinge 54. When the swing plate 53 is pivoted down against the top surface of the cover 43, a U-shaped engaging portion 57 (FIG. 2) depending from one side edge of the swing plate 53 is brought into snapping engagement with an engagement protuberance 56 extending from one side wall of the cover 43 to secure the plate to the cover. With the high-voltage focusing lead cable G3 inserted through the lead cable insertion aperture 48 into between the fixing plate 35 and the contact tab 37, upon the swing plate 53 being pivoted to press down the top surface of the cover 43 as stated above, the receiving plate 39 is subjected on its side face to a lateral force from the retaining tab 51 to be resiliently urged toward the fixing plate 35 as shown in FIG. 4. As a result, the lead cable pinching member 30 may be locked in place with the focusing lead cable G3 pinched between the fixing plate 35 and the contact tab 37 with an increased pressure. In addition, the contact tab 37 has its forward end oriented to present a sharp edge in a direction opposite to the direction of withdrawal of the lead cable to thereby act as a stop to prevent dislodgement of the lead cable. It is thus to be understood that this arrangement insures positive electrical and mechanical connection of the focusing lead cable G3 with little possibility of dislodgement.

The fixing plate 35, the contact tab 37, the slot 52, the insertion aperture 48, the tubular projection 49, the retaining tab 51, the swing plate 53 and the hinge 54 shown in FIG. 4 constitutes a high-voltage lead cable connector section 200. When it is desired to withdraw the high-voltage focusing lead cable G3 from the high-voltage lead cable connector section 200, it is only required to turn the swing plate 53 to dislodge the retaining tab 51 from the slot 52 to thereby unlock the lead cable pinching member 30. This type of connector section 200 is called lead cable quick-connection type because locking and unlocking of the lead cable pinching member 30 may be readily effected. The cathode-ray tube socket as described above is disclosed in U.S. Pat. No. 4,822,301, for example.

The cathode-ray tube socket 11 is mounted on the surface of a printed-circuit board 100 for a cathode-ray tube, for example as shown schematically in FIG. 6, and the terminals 18T (see FIGS. 1 and 2) of some preselected ones of the contacts 18 are passed through terminal holes 110 formed through the printed-circuit board 100 as shown schematically in broken lines and soldered to the printed wiring in the back surface of the board through which printed wiring the terminals are electrically connected with a board-in connector 108 and a connector pin 103 mounted on the top surface of the board. The cathode-ray tube has its terminal pins inserted into the terminal-pin insertion apertures 16 of the cathode-ray tube socket 11 to be contact connected with the contacts 18 accommodated in the apertures 16. In addition, the high-voltage lead cables G2 and G3 extending from a flyback transformer, not shown are coupled to the connector pin 103 and the tubular projection 49, respectively. The lead cable G3 is a high-voltage focusing lead cable for supplying focusing voltage in the order of 10 kV from the flyback transformer. The cable G2 is a screening lead cable for supplying screening voltage in the order of 1 kV from the flyback transformer. Connected to the board-in connector 108 are a lead cable G1, a cathode lead cable 4C and a heater lead cable 4H extending from a main board (not shown). While only three lead cables are illustrated here, actually about seven lead cables including other lead cables from the main board are connected to the connector 108 and then connected through the printed circuit of the printed-circuit board 100 with the corresponding terminals of the cathode-ray tube socket 11 to provide relatively low voltage in the order less than 100 V.

The terminal of an anode cable 4A from the flyback transformer is connected by hand directly to an anode terminal, not shown, of the cathode-ray tube to provide an anode voltage in the order of 30 kV. Terminal holes 105, 106 are used to connect individual components such as resistances, capacitors and the like. Although not shown, a grounding lead cable besides the lead cable G2 may also be connected to the printed-circuit board 100 of the cathode-ray tube to lead the grounding terminal pin of the cathode-ray tube socket to the main board or the frame of the associated apparatus.

Heretofore, the screening lead cable G2 has been connected to the cathode-ray tube printed-circuit board 100 by preliminarily securedly soldering the connector pin 103 protruding from the top surface of the printed-circuit board 100 through a G2 insertion hole 102 formed through the board to the printed circuit formed in the back surface of the printed-circuit board 100, and fitting the crimp terminal 104 attached to the distal end of the screening lead cable G2 over the connector pin 103 protruding from the board. Alternatively, instead of providing the connector pin 103, the connection of the lead cable G2 has been effected by introducing the distal end of the core of the lead cable G2 from the top surface of the printed-circuit board 100 through the G2 insertion hole 102 formed through the board to the back surface of the board and connecting the distal end of the core directly to the printed circuit in the back surface of the board by hand-soldering. As shown in broken lines in FIG. 6, the lead cables G1 and G2, the cathode lead cable 4C and the heater lead cable 4H are connected with the corresponding terminals 18T and hence the corresponding contacts 18 of the cathode-ray tube socket 11 through the printed circuit in the back surface of the board 100.

In this regard, it should be noted that despite the fact that most of the surface mounted components on the cathode-ray tube printed-circuit board 100 are dip-soldered to the board, the connection of the lead cable G2 is made by hand-soldering to the cathode-ray tube printed-circuit board 100 separately from those components, which is undesirable from the viewpoint of efficiency in the connecting operation. In contrast, in the case that the connection of the lead cable G2 is made by means of the connector pin 103 provided on the cathode-ray tube printed-circuit board 100, it is required to attach the crimp terminal 104 on the side of the screening lead cable G2. The need for the operation of pressure attaching the climp terminal 104 to the screening lead cable G2 also adds to the complexity of the connecting operation. When the grounding lead cable from the main board (not shown) is connected to the earthing pin of the cathode-ray tube, it has been a common practice to connect the grounding lead cable directly to the terminal 18T corresponding to the earthing pin.

As discussed above, the conventional cathode-ray tube socket known as the lead cable quick-connection type was configured to provide for connection to the socket without the need for soldering with respect to the focusing lead cable G3, but still required the use of soldering or the aforesaid climp terminal and pin for connection of the screening lead cable G2 or the grounding lead cable (see the Japanese Patent Application Publication Kokai No. 9-50837).

A high voltage is applied to the screening lead cable G2. In view of this, when the screening lead cable G2 is connected to the corresponding terminal of the cathode-ray tube socket through the printed wiring of the printed-circuit board 100 to which the cathode-ray tube socket is mounted, it is required to make provision for preventing deleterious influences such as electrical leakage from being exerted on the terminals of electrical components inserted in the terminal holes 105, 106 adjacent the G2 insertion hole 102, the printed wiring adjacent the printed wiring extending from the G2 insertion hole 102 up to the terminal hole 110*b* for the corresponding socket terminal, and the socket terminals inserted in the terminal holes 110*a* and 110*c* adjacent said corresponding socket terminal, and others. To this end, there are formed in the printed-circuit board two slits 101 extending from locations intermediate the G2 insertion hole 102 and the terminal holes 110*a* and 110*c* to locations intermediate the terminal hole 110*b* associated with the G2 insertion hole 102 and the terminal holes 110*a* and 110*c* adjacent the terminal hole 110*b*. However, if the printed-circuit board is miniaturized with increased packaging density in order to accommodate miniaturization of the entire apparatus, there would be no room for providing the slits 101.

In addition, the quick-connection type connector disclosed in the aforesaid Japanese Patent Application Publication Kokai No. 9-50837 is mechanically separate from the socket body, requiring a correspondingly increased number of parts and hence additional steps of operation for assembling and connecting the quick-connection type connector.

SUMMARY OF THE INVENTION

An object of this invention is to provide a cathode-ray tube socket configured to permit the connecting of a screen lead cable leading from a flyback transformer as well as other wires without the need for soldering or the use of a climp terminal.

Briefly stated, the cathode-ray tube socket according to this invention comprises:

a socket body having a plurality of contact seating sections each adapted to accommodate one of a plurality of contacts to be connected with a plurality of terminal pins of a cathode-ray tube to which the socket is to be mounted, and a high-voltage contact seating section adapted to accommodate a high-voltage contact to be connected with a high-voltage terminal pin of the cathode-ray tube, the contact seating sections and the high-voltage contact seating section being formed in the socket body and arrayed on a common circle;

a high-voltage discharge chamber formed integrally with the socket body at a first location on a peripheral side wall of the body and accommodating a pair of spaced apart and opposed high-voltage discharge electrodes therein;

a first quick-connection type lead cable connector section formed integrally with the high-voltage discharge chamber and including a first lead cable pinching chamber having a first lead cable pinching member housed therein for pinching a first lead cable to be inserted from the exterior, the first lead cable pinching member being connected with the high-voltage contact accommodated in said high-voltage contact seating section; and a second quick-connection type lead cable connector section formed integrally with the socket body at a second location on the peripheral side wall of the body and including a second lead cable pinching chamber having a second lead cable pinching member housed therein for pinching a second lead cable to be inserted from the exterior, the second lead cable pinching member being connected with a low-voltage contact accommodated in one of the plurality of contact seating sections.

DETAILED DESCRIPTION OF THE PREFERRED EMBODIMENTS

Figure 1:
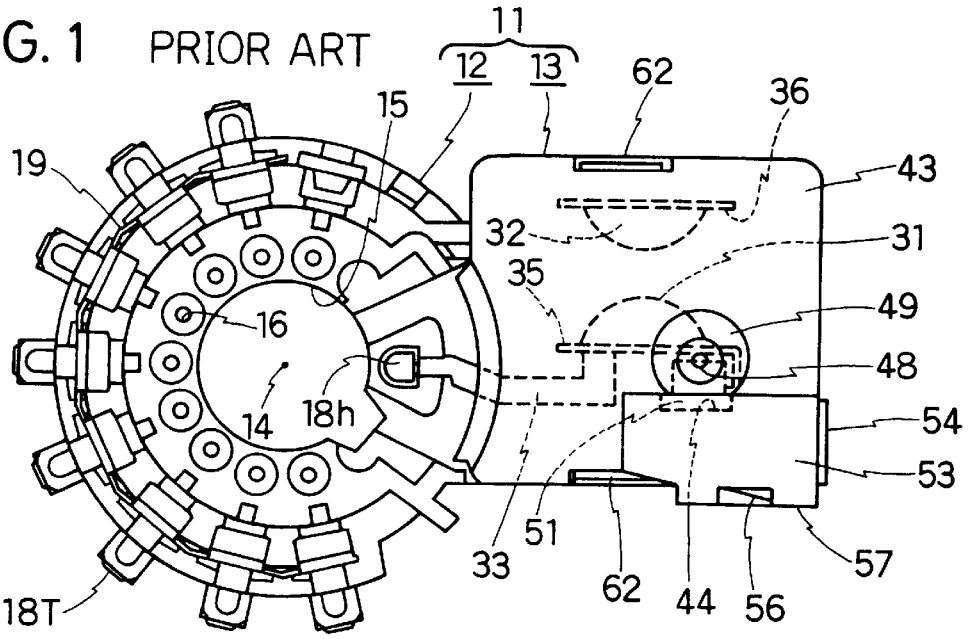
FIG. 1 PRIOR ART
FIG. 1 is a plan view of the prior art cathode-ray tube socket.
Figure 2:
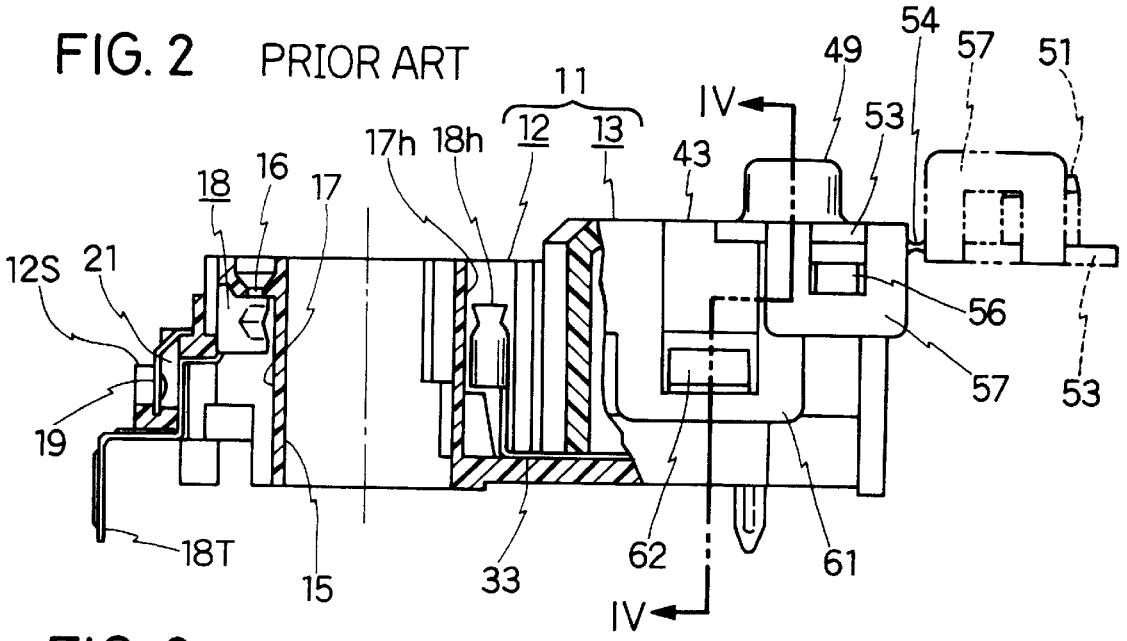
FIG. 2 PRIOR ART
FIG. 2 is a plan view, partly in cross-section, of the cathode-ray tube socket shown in FIG. 1.
Figure 3:
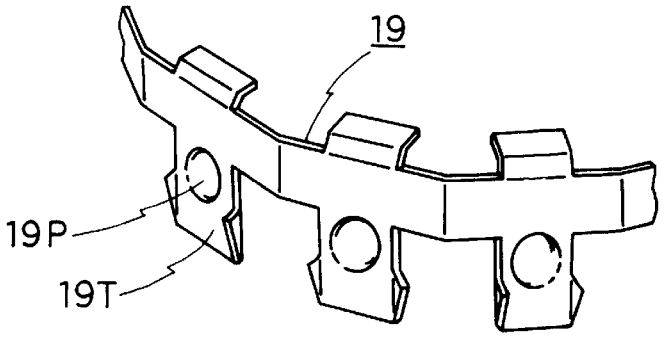
FIG. 3 PRIOR ART
FIG. 3 is a perspective view of a grounding conductor used with the cathode-ray tube socket shown in FIG. 1.
Figure 7:
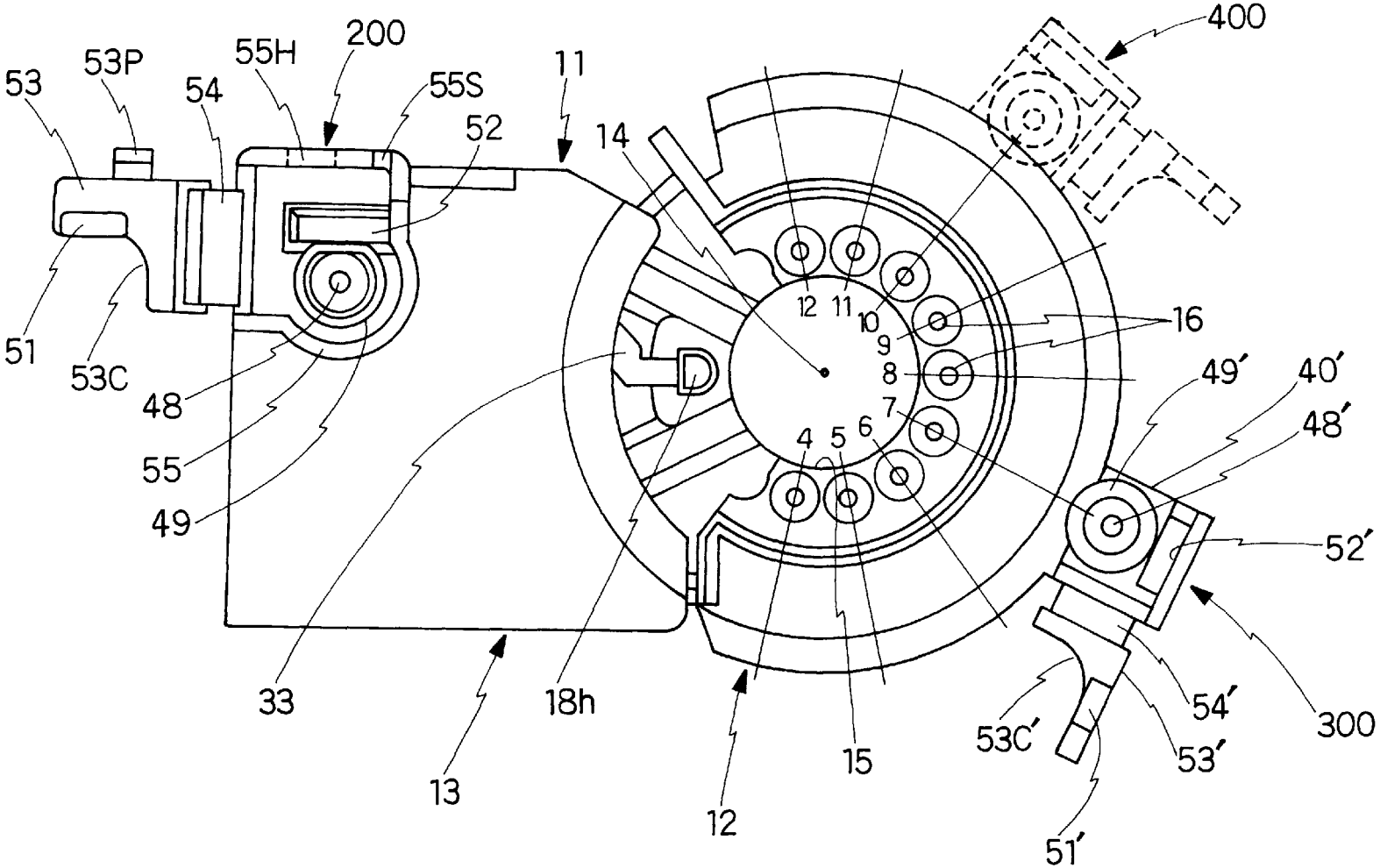
FIG. 7 is a plan view illustrating an embodiment of the cathode-ray tube socket according to this invention.
Figure 8:
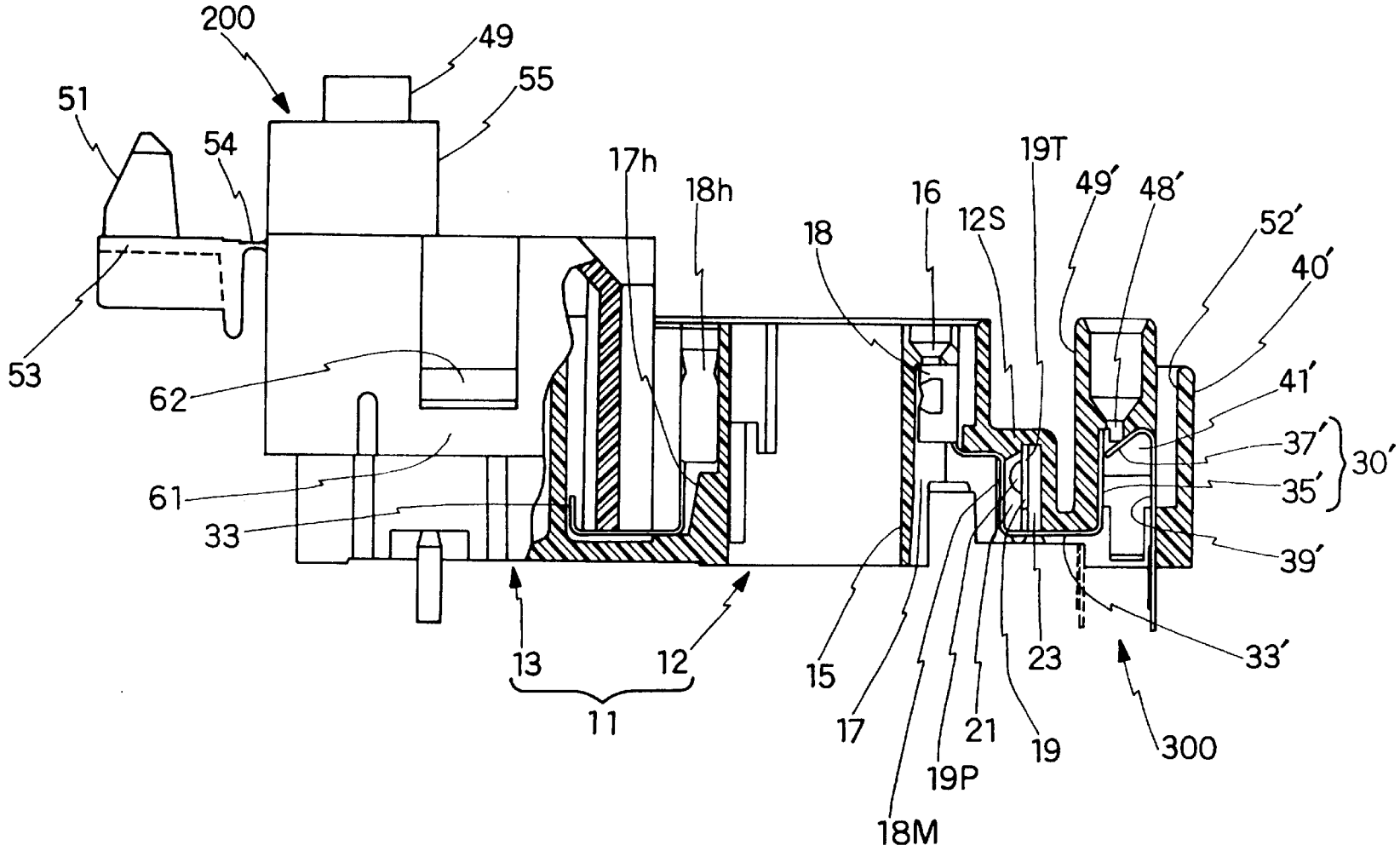
FIG. 8 is a view, partly in cross-section, of the cathode-ray tube socket shown in FIG. 7.

An embodiment of this invention will be described with reference to FIGS. 7 and 8. FIG. 7 is a plan view illustrating the cathode-ray tube socket of this invention seen from the top while FIG. 8 is a view, partly in cross-section, of the socket. In FIGS. 7 and 8, those components which are similar to components of the prior art example are designated by like reference numerals. The construction of the socket body 12 having an array of contact seating sections 17 and high-voltage contact seating section 17*h* is similar to that of the prior art shown in FIGS. 1 and 2, and the construction of low-voltage contacts 18 and a high-voltage contact 18*h* accommodated in the contact seating sections 17 and the high-voltage contact seating section 17*h*, respectively is also basically similar to those of the prior art shown in FIGS. 1 and 2. In addition, the construction of the high-voltage discharge chamber 13 having a first high-voltage lead cable connector section 200 and the high-voltage discharge electrodes 31, 32 disposed in the high-voltage discharge chamber 13 is also similar to those of the prior art. Further, the cover 43 and the housing 42 are formed with U-shaped engaging portions 61 and engagement protuberances 62, respectively for snapping engagement with each other, as described above with reference to FIG. 2.

Figure 4:
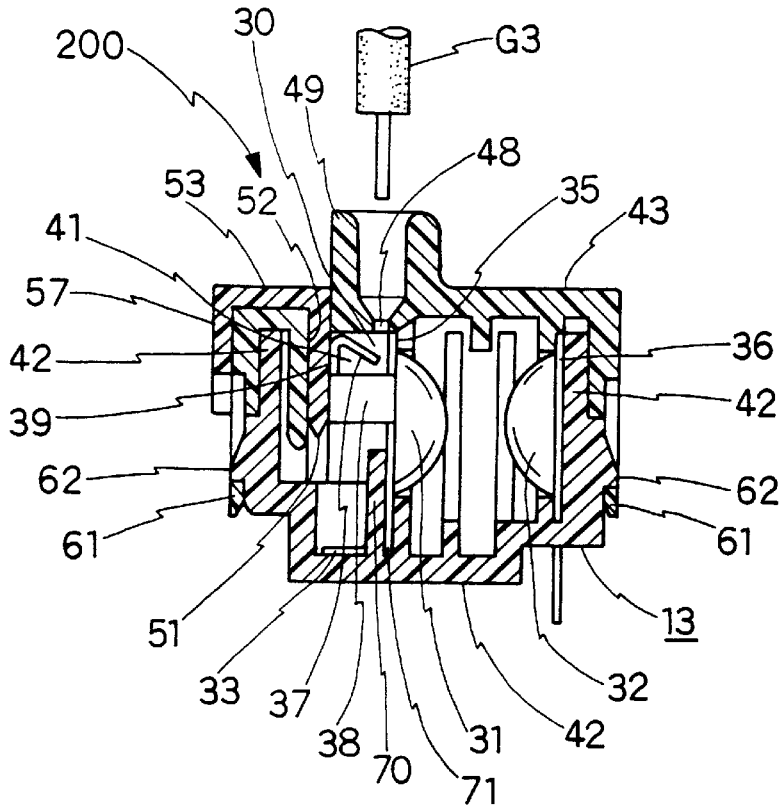
FIG. 4 PRIOR ART
FIG. 4 is a cross-sectional view taken along the lines IV—IV in FIG. 2 illustrating the first high-voltage lead cable connector section.

However, this embodiment of the invention is distinguished from the prior art in that the swing plate 53 of the first high-voltage lead cable connector section 200 is formed with a cutout notch 53C so as to avoid interference of the plate 53 with the tubular projection 49 outstanding from the top surface of the cover 43 to permit the lead cable pinching chamber 41 (see FIG. 4) to be located as close to the side of the housing 42 as possible. Additionally, the cover 43 has a peripheral wall 55 extending from the top surface thereof so as to surround the tubular projection 49 and the swing plate 53. Formed through the central portion of one side wall section of the peripheral wall 55 lying in the same plane as the side of the cover 43 is a rectangular engagement hole 55H. That side wall section of the peripheral wall 55 is further formed adjacent one corner thereof with a cut-in groove 55S extending from the upper edge downwardly to facilitate resilient flexing of the side wall section. The swing plate 53 has an engaging protuberance 53P formed integrally with one side edge thereof such that when the swing plate 53 is pivoted down against the top surface of the cover 43, the engaging protuberance 53P is snapped into the engagement hole 55H to secure the plate to the cover.

Figure 9:
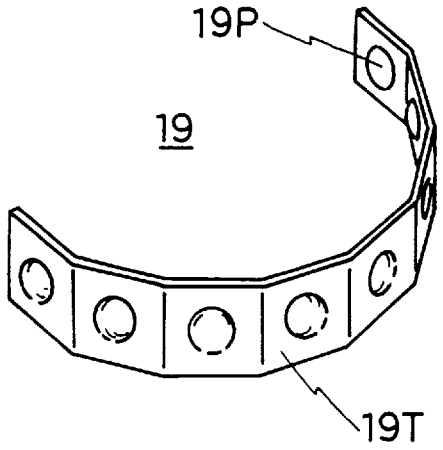
FIG. 9 is a perspective view of an example of the rounding conductor 19 shown in FIG. 8.

While in the aforesaid prior art example the grounding conductor 19 is illustrated as being mounted in an exposed state on the stepped portion 12S formed around the outer periphery of the socket body 12, in this embodiment of the invention the stepped portion 12S of the socket body 12 is formed therein with a channel 23 cut in from the undersurface of the socket arcuately about the central line 14. In the channel 23 there are defined discharge chambers 21 spaced at equal angular intervals in correspondence with the middle portions of the terminals of the annularly arrayed respective contacts 18. Mounted in the arcuate channel 23 is a grounding conductor 19 comprising an array of discharge electrodes 19T interconnected in the form of a strip and each having a spherical protrusion 19P in the center thereof as shown in FIG. 9. The contacts 18 are mounted on the socket body 12 such that the middle portions of the terminals 18T of the contacts 18 are in spaced opposing relationship to the corresponding spherical protrusions 19P of the grounding conductor 19 in the respective discharge chambers 21 so as to define discharge gaps therebetween. That is, discharge gaps are defined between the contacts 18 and the associated spherical protrusions 19P of the grounding conductor 19. It should be noted, however, that the construction of the stepped portion 12S itself has nothing to do with the essence of this invention, but that this embodiment of the invention may also use the construction of the stepped portion 12S illustrated in the previously described prior art example or any other suitable construction.

While this embodiment of the invention is similar to the aforesaid prior art cathode-ray tube socket in that the first high-voltage lead cable connector section 200 capable of quick connection of the focusing lead cable G3 is constructed integrally with the socket at one corner of the high-voltage discharge chamber 13, in this embodiment of the cathode-ray tube socket according to this invention a second high-voltage lead cable connector section 300 capable of quick connection of the screening lead cable G2 is constructed integrally with the socket body 12 on the peripheral side wall thereof. The second high-voltage lead cable connector section 300 may be generally similar in construction to the first high-voltage lead cable connector section 200. Specifically, the second high-voltage lead cable connector section 300 comprises a box-like housing 40' having a lead cable pinching chamber 41' defined therein, a tubular projection 49' extending integrally upwardly from the top surface of the box-like housing 40', a swing plate 53' connected integrally with one side edge of the top surface of the box-like housing 40' by means of a hinge 54', and a retaining tab 51' extending at a right angle from the side edge of the plate 53 perpendicular to hinge 54'. The top wall of the box-like housing 40' is formed radially outwardly of and adjacent the tubular projection 49' with a slot 52 communicating with the interior of the lead cable pinching chamber 41, and a lead cable insertion aperture 48' is formed through the top wall of the box-like housing 40' in the center of the tubular projection 49'. In this second high-voltage lead cable connector section 300 as well, the swing plate 53' is formed with a cutout notch 53C' so as to avoid interference of the plate 53' with the tubular projection 49' when the swing plate 53' is pivoted down against the top wall of the box-like housing 40' for the purpose of minimizing the amount of radial projection of the plate 53' from the outer periphery of the socket body 12.

Figure 10:
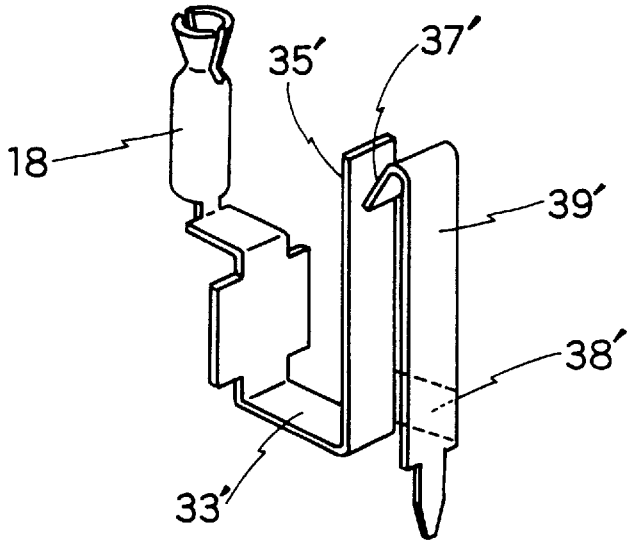
FIG. 10 is a perspective view illustrating an example in which the contact 18, the fixing plate 35', the receiving plate 39' and the contact tab 37' are formed in one piece.

Disposed in the lead cable pinching chamber 41' are a fixing plate 35' extending upwardly from a connecting conductor 33' which in turn extends integrally from the contact 18 for connecting the screening lead cable G2' of the cathode-ray tube socket as shown in FIG. 10, a connecting portion 38' extending integrally laterally from the lower side edge of the fixing plate 35', a receiving plate 39' formed integral with and vertically extending from the outer end of the connecting portion 38' in spaced and opposing relation to the fixing plate 35', and a contact tab 37' formed by bending the upper end portion of the receiving plate 39' downwardly obliquely toward the fixing plate 35'. While in this embodiment the receiving plate 39' is formed integral with the fixing plate 35' by means of the connecting portion 38' as in the example of FIG. 5, the receiving plate 39' and the fixing plate 35' may be provided separately without providing the connecting portion 38'. It is seen that the upper end portion of the receiving plate 39' is bent downwardly obliquely at an acute angle with respect to the fixing plate 35' to form the contact tab 37'. The fixing plate 35' and the contact tab 37' thus constitutes a lead cable pinching member 30'.

In this second high-voltage lead cable connector section 300, the leading end of the screening lead cable G2 which is an external lead cable may be inserted through the insertion aperture 48' while guided by the tubular projection 49' into the lead cable pinching chamber 41' so as to abut the leading end of the core of the lead cable G2 against the forward end portion of the contact tab 37'. Continued insertion will displace the contact tab 37' toward the slot 52' to resiliently hold the leading end of the cable between the flat face of the fixing plate 35' and the end edge of the contact tab 37'. In this condition in which the receiving plate 39' is moved slightly into the slot 52', when the swing plate 53' is pivoted about the hinge 54' to insert the retaining tab 51' into the slot 52', the receiving plate 39' is urged toward the fixing plate 35' to pinch the leading end of the lead cable G2 with an increased force. This may lock the lead cable pinching formation 30' constituted by the contact tab 37' and the fixing plate 35'. When it is desired to withdraw the lead cable G3 from the lead cable pinching member 30', it is only required to unlock the pinching member 30' simply by removing the retaining tab 51' from the slot 52'.

As stated above, the second high-voltage lead cable quick-connection type connector section 300 adapted for receiving and pinching the screening lead cable G2 is formed integral with the peripheral side wall of the socket body 12 into which the terminal pins of the cathode-ray tube are attached. For the small-neck cathode-ray tube socket shown in FIG. 7, the location where the lead cable connector section 300 is formed integral with the socket is at a position on the socket body 12 radially adjacent the position of the terminal No. 7 or the position of the terminal No. 10. In the case of the miniature-neck cathode-ray tube socket, though not shown in the drawings, there are provided seven contact seating sections 17 which are given terminal numbers No. 3 through No. 9 in counterclockwise direction in the same way as in FIG. 7, and the screening lead cable connector section 300 is formed integral with the socket at a position radially adjacent the position of the terminal No. 8. 49' is the tubular projection of the second high-voltage lead cable connector section 300, and the lead cable insertion aperture formed through the bottom of the tubular projection 49'.

Figure 5:
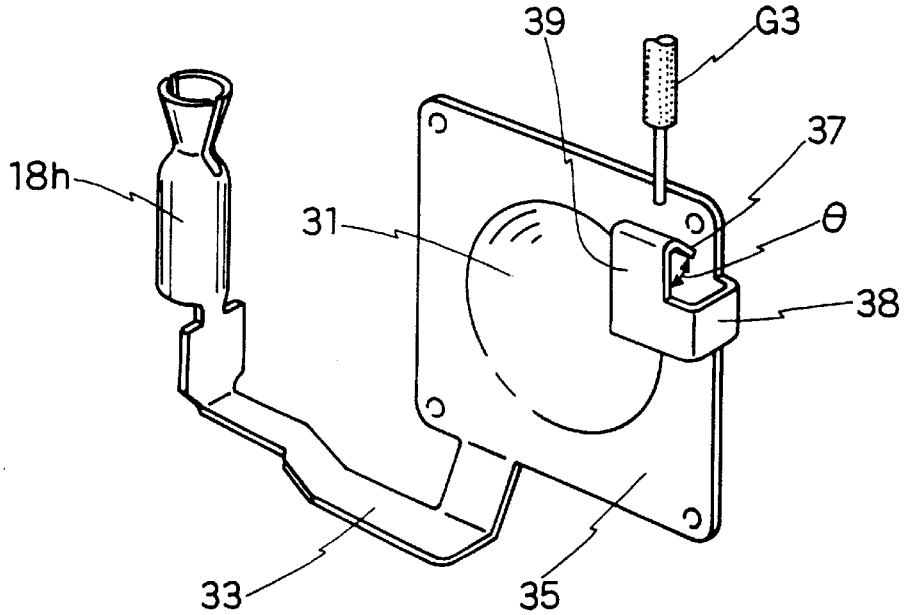
FIG. 5 PRIOR ART
FIG. 5 is a perspective view illustrating the connecting conductor and the pinching formation.
Figure 6:
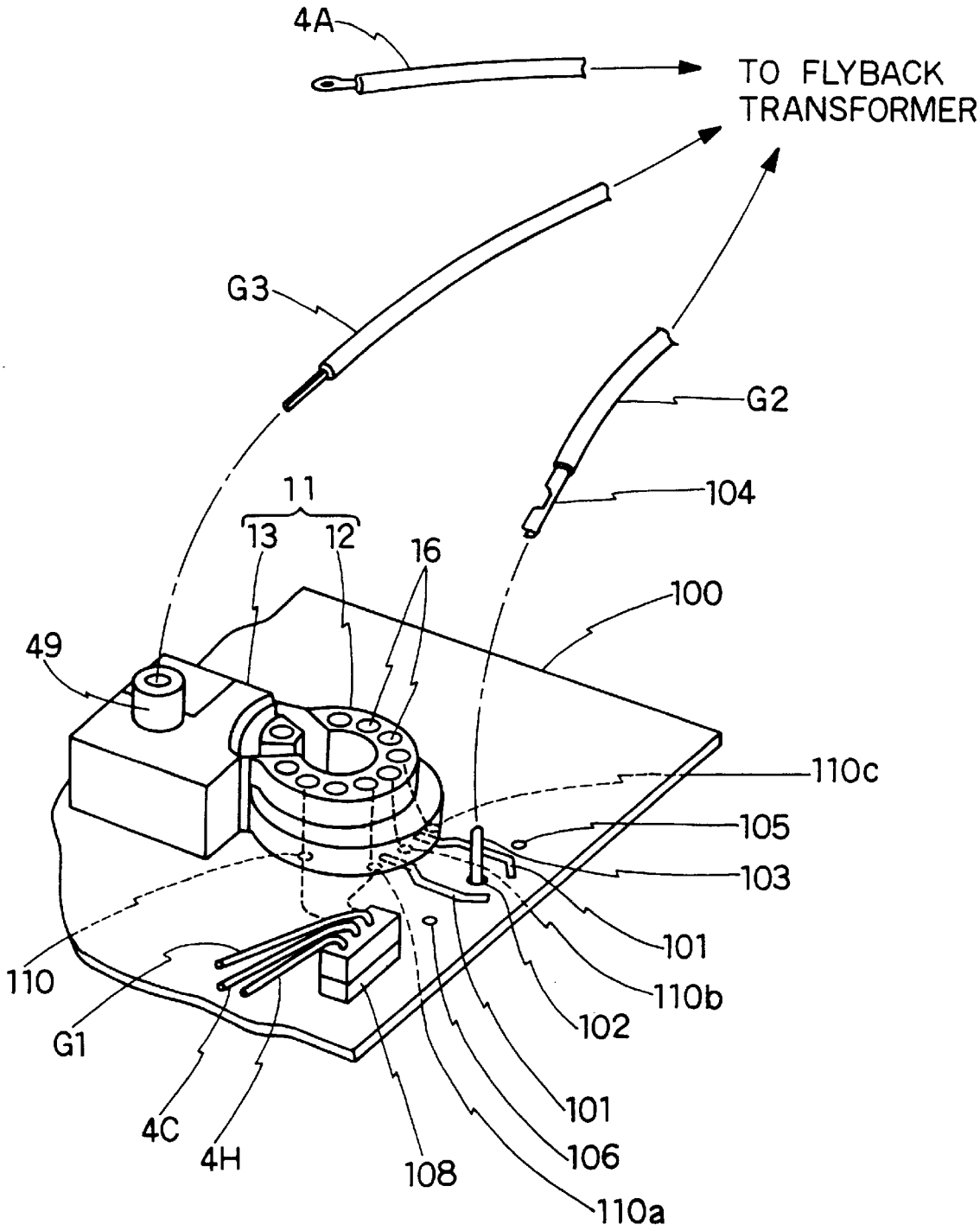
FIG. 6 PRIOR ART
FIG. 6 is a perspective view illustrating the cathode-ray tube printed-circuit board.
Figure 11:
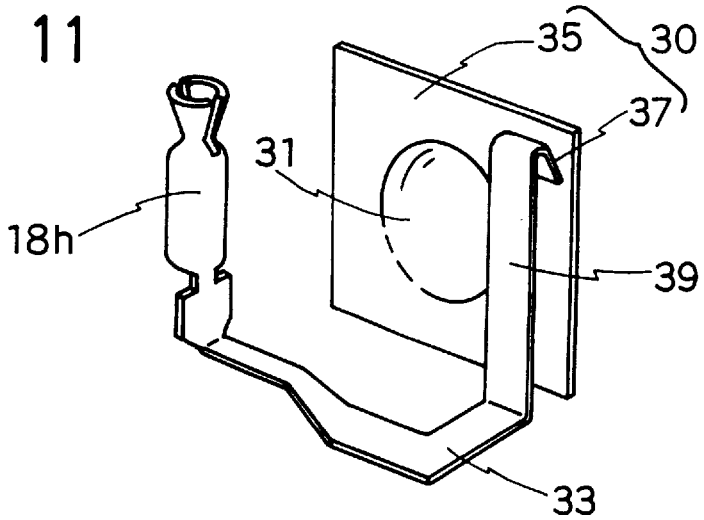
FIG. 11 is a perspective view illustrating an example in which the high-voltage contact 18*h* and the fixing plate 35 shown in FIGS. 8 and 9 are formed separately.

In the aforesaid embodiment of the invention, the contact tab 37 and the receiving plate 39 in the first high-voltage lead cable connector section 200 have been described as being formed integral with the fixing plate 35 of the high-voltage discharge electrode 31 by means of the connecting portion 38 as in the example of FIG. 5 and the high-voltage contact 18*h* has been described as being formed integral with the fixing plate 35 by means of the connecting conductor 33. However, as illustrated in FIG. 11, the high-voltage discharge electrode 31 having the fixing plate 35 may be formed separately from the high-voltage contact 18*h* and the high-voltage contact 18*h* and the receiving plate 39 may be formed integral with the high-voltage contact 18*h* by means of the connecting conductor 33. In this case, the receiving plate 39 bent upwardly at a right angle from the connecting conductor 33 is positioned in spaced opposing relationship to the fixing plate 35. With the lead cable G2 inserted in the lead cable pinching member 30 and locked in place by the retaining tab 51, the fixing plate 35 10 and the contact tab 37 allow for discharging unexpectedly high voltage from high-voltage discharge electrode. 31 to the opposed high-voltage discharge electrode 32.

While in the aforesaid embodiment of the invention the second high-voltage lead cable connector section 300 has been described as being designed for connection of the screening lead cable G2, it may be designed for connection of the grounding lead cable from the main board and located at an angular position corresponding to the contact 18 connecting with the earthing pin of the cathode-ray tube terminal pins. Alternatively, in addition to the second lead cable connector section 300 for the screening lead cable G2, a third lead cable connector section 400 of the similar construction may be provided for connection of the grounding lead cable as shown in broken lines in FIG. 7. It will be appreciated that providing a plurality of quick-connection type lead cable connector sections integrally with the socket body around the peripheral side wall thereof as described hereinabove allows for easily connecting not only the high-voltage screening lead cable but also the grounding lead cable as required to the cathode-ray tube socket. Additionally, this arrangement may readily accommodate a design change in the exciter circuit of the cathode-ray tube or a change in number of the pins used.

EFFECTS OF THE INVENTION

As discussed hereinabove, according to this invention, providing quick-connection type lead cable connector sections integrally with the socket body at desired angular positions around the peripheral side wall thereof allows for connecting all of the lead cables including the screening lead cable and the grounding lead cable to the cathode-ray tube socket efficiently and inexpensively without resort to hand-soldering or the use of climp terminals.

Forming the second lead cable connector section integral with the cathode-ray tube socket permits the region of the printed-circuit board which would have been occupied by the second lead cable connector section to be put to other uses, contributing to an enhancement of the space factor.

Additionally, from the standpoint of the component construction, this invention only requires replacement of the low-voltage contacts which were connected directly to the printed-circuit board or were not in use, so that the cathode-ray tube socket of this invention is not accompanied with substantial variation in the component unit cost and may share the same manufacturing facility with the conventional components.

Besides, provision of a plurality of the second lead cable connector sections may accommodate a design change in the exciter circuit of the cathode-ray tube or a change in number of the pins used.

Moreover, not only high insulating property may be provided, but also stable voltage may be continually applied without deleterious influences of leakage current by connecting lead cables directly to the cathode-ray tube socket without the intermediation of the printed-circuit board.

I claim:

1. A cathode-ray tube socket, comprising:

a socket body having a plurality of contact seating sections each adapted to accommodate one of a plurality of contacts to be connected with a plurality of terminal pins of a cathode-ray tube to which said socket is to be mounted, and a high-voltage contact seating section adapted to accommodate a high-voltage contact to be connected with a high-voltage terminal pin of said cathode-ray tube, said contact seating sections and said high-voltage contact seating section being formed in said socket body and arrayed on a common circle;

a high-voltage discharge chamber formed integrally with said socket body at a first location on a peripheral side wall of the body and accommodating a pair of spaced apart and opposed high-voltage discharge electrodes therein;

a first quick-connect type lead cable connector section formed integrally with said high-voltage discharge chamber and including a first lead cable pinching chamber having a first lead cable pinching member housed therein for pinching a first lead cable to be inserted from the exterior of said voltage discharge chamber, said first lead cable pinching member being connected with said high-voltage contact accommodated in said high-voltage contact seating section; and a second quick-connect type lead cable connector section formed integrally with said socket body at a second location on the peripheral side wall of the body and including a second lead cable pinching chamber having a second lead cable pinching member housed therein for pinching a second lead cable to be inserted from the exterior of said socket body, said second lead cable pinching member being connected with a low-voltage contact accommodated in one of said plurality of contact seating sections; and wherein said first lead cable is a focusing lead cable, and said second lead cable is a screening lead cable or a ground cable.

2. The cathrode-ray tube socket of claim 1 wherein each of said first and second lead cable pinching member includes a fixing plate, a receiving plate spaced from and opposing said fixing plate, and a contact tab formed by bending the forward end portion of said receiving plate at an acute angle and positioned in proximity to said fixing plate, and each of said first and second lead cable connector sections having a top wall formed with a lead cable insertion aperture communicating with said associated lead cable pinching chamber for guiding a lead cable to a preselected location on said associated contact tab in proximity to said fixing plate.

3. The cathode-ray tube socket of claim 2 wherein said first and second lead cable connector sections are formed with slots for communicating the respective lead cable pinching chambers to the exterior, and each of said first and second lead cable connector sections includes a swing plate joined integrally with one end of the associated top wall by means of a hinge, and a retaining tab formed integrally with said retaining tab such that the retaining tab may be inserted into and removed from associated one of said associated slots to mechanically lock and unlock associated one of said first and second lead cable connector sections as the swing plate is pivoted about said hinge.

4. The cathode-ray tube socket of claim 3 wherein each of said first and second lead cable connector sections has a tubular projection extending from the upper surface of said top wall, said tubular projection being concentric with and surrounding said lead cable insertion aperture.

5. The cathode-ray tube socket of claim 1 wherein a third lead cable connector section similar in construction to said second lead cable connector section is formed integral with said socket body on the peripheral side wall of the body.

6. The cathode-ray tube socket of claim 2, 3 or 4 wherein said fixing plate and said receiving plate of said first lead cable pinching member are formed in one piece.

7. The cathode-ray tube socket of claim 2, 3 or 4 wherein said fixing plate and said receiving plate of said first lead cable pinching member are formed separately from each other.

8. The cathode-ray tube socket of claim 2, 3 or 4 wherein said fixing plate and said receiving plate of said second lead cable pinching member are formed in one piece.

9. The cathode-ray tube socket of claim 2, 3 or 4 wherein said fixing plate and said receiving plate of said second lead cable pinching member are formed separately from each other.

10. The cathode-ray tube socket of claim 4 wherein said swing plate of said first lead cable connector section is formed with a notch to prevent interference of said swing plate with said tubular projection.

11. The cathode-ray tube socket of claim 4 wherein said swing plate of said second lead cable connector section is formed with a notch to prevent interference of said swing plate with said tubular projection.

* * * * *